United States Patent [19]

Barth et al.

[11] 4,456,073

[45] Jun. 26, 1984

[54] FLEXIBLE CONNECTION APPARATUS

[75] Inventors: James R. Barth, Houston; Joe R. Fowler, Spring; Wilbur A. Hitchcock; Jack E. Miller, both of Houston, all of Tex.

[73] Assignee: Exxon Production Research Co., Houston, Tex.

[21] Appl. No.: 410,750

[22] Filed: Aug. 24, 1982

[51] Int. Cl.[3] ..... E21B 17/01

[52] U.S. Cl. ..... 166/367; 405/195; 175/7; 166/355; 166/368

[58] Field of Search ..... 175/7; 166/355, 366, 166/367, 359, 368; 405/195; 138/118; 114/264, 265, 122

[56] References Cited

U.S. PATENT DOCUMENTS

| | | | |
|---|---|---|---|
| 3,461,916 | 8/1969 | Ledgerwood | 138/120 |
| 3,482,408 | 12/1969 | Manning | 166/368 |
| 3,913,668 | 10/1975 | Todd et al. | 166/359 |
| 4,067,202 | 1/1978 | Reed | 405/195 |
| 4,125,162 | 11/1978 | Groves et al. | 166/368 |

*Primary Examiner*—Ernest R. Purser
*Assistant Examiner*—Mark J. DelSignore
*Attorney, Agent, or Firm*—Alan J. Atkinson

[57] ABSTRACT

A flexible connection apparatus is disclosed for accommodating relative movement between a compliant offshore structure and the sea floor. The compliant offshore structure supports a fluid-carrying system which conveys fluids between the sea floor and the structure. The fluid-carrying system includes a riser and a helical flowline. The lower end of the riser is connected to the sea floor. The first end of the helical flowline is connected to the upper end of the riser and the second end of the helical flowline is connected to the structure. As the compliant offshore structure is displaced from its vertical equilibrium position due to loading forces induced by wind, waves, and ocean currents, the helical flowline elastically flexes through torsional deflection to accommodate such movement. In a preferred embodiment of the apparatus, a wellhead is connected between the riser and the helical flowline such that the centerline of the helical flowline is substantially vertical. In yet another embodiment of the apparatus, a bending flowline is connected between a wellhead and the structure with its centerline being substantially horizontal to accommodate movement of the structure through bending deflection rather than by torsional deflection.

13 Claims, 4 Drawing Figures

FLEXIBLE CONNECTION APPARATUS

FIELD OF THE INVENTION

Figure 1:
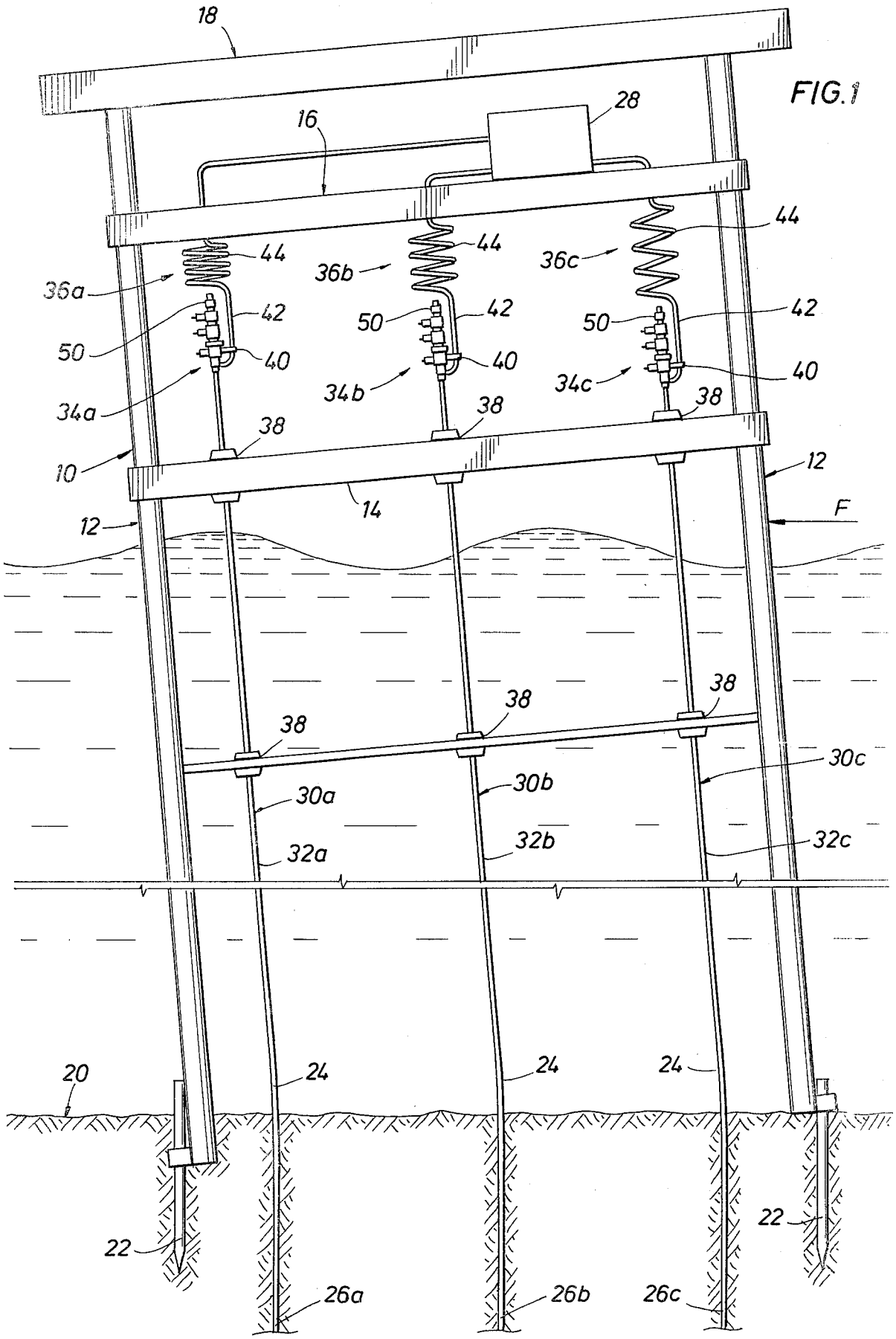

The present invention discloses an apparatus in a fluid-carrying system for accommodating relative movement between a compliant offshore structure and the sea floor. More particularly, the present invention relates to a helical flowline in a fluid-carrying system which is capable of flexing to accommodate relative movement between a compliant offshore structure and a subsea well.

BACKGROUND OF THE INVENTION

The offshore production of oil and gas requires the use of fluid-carrying systems to convey production fluids from a subsea well to the water surface. Such fluid-carrying systems typically include a rigid, substantially vertical conductor pipe which is cemented at its lower end to the subsea well. The upper end of the conductor pipe is connected to a wellhead which is typically located on the deck of an offshore production platform. Tubing, which is located inside the conductor pipe, conveys production fluids from the subsea well to the wellhead. At the upper end of the wellhead, valves in a "Christmas Tree" are manipulated to regulate the pressure and flow rate of the production fluids. A flowline conveys production fluids from the Christmas Tree to a manifold on the deck of the offshore platform. The manifold routes the production fluids to treating and separation equipment which processes the production fluids. The flowline is rigidly anchored to the deck of the offshore platform or is rigidly connected to the manifold. Such rigid connection completes the fluid-carrying system between the subsea well and the offshore platform.

While rigid offshore production platforms are typically used to support a fluid-carrying system in water less than 1000 feet deep, compliant offshore platforms such as guyed towers or tension leg platforms have been designed for greater water depths. Such compliant offshore platforms are less massive than are rigid offshore platforms and "comply" with loading forces induced by wind, waves, and ocean currents. When acted upon by such forces, a compliant offshore platform will be displaced from its equilibrium position above a subsea well. Such displacement may be vertical as well as horizontal. As the displacing force subsides, the compliant offshore platform will return to its equilibrium position above the subsea well.

A fluid-carrying system supported by a compliant offshore platform must be sufficiently flexible to compensate for movement of the compliant offshore platform from its equilibrium position. Fluid-carrying systems typically compensate for such movement by using a flexible flowline, such as an elastomeric hose, between the wellhead and the deck of the offshore platform. However, a flexible flowline manufactured from an elastomeric hose is subject to certain limitations. For example, "sour" production fluids frequently contain chemical compounds such as hydrogen sulfide and carbon dioxide which deteriorate the materials used in an elastomeric hose. Thus, an elastomeric hose carrying sour production fluids must be periodically replaced. In addition, the pressure of the production fluids may exceed 5000 psi. An elastomeric hose must be reinforced in order to handle such fluid pressures without failing. Such reinforcement reduces the flexibility of an elastomeric hose and correspondingly increases the minimum bending radius of the hose. An elastomeric hose with a greater bending radius will therefore require more deck space than will a hose with a lesser bending radius. Consequently, the use of elastomeric hoses will reduce the number of wells that can be produced by an offshore platform.

In addition to elastomeric hoses, slip joints have been used in a fluid-carrying system to compensate for movement of a compliant offshore platform from its equilibrium position. Such joints typically have an inner pipe which slidably moves within an outer pipe. The annulus between the inner and outer pipe is sealed with elastomeric seals to prevent production fluid from leaking into the ambiance. However, slip joints are undesirable in a fluid-carrying system between a wellhead and an offshore platform. Slip joints sized to accommodate the movement of an offshore platform are long and therefore require a great deal of vertical space between the decks of the offshore platform. Such space is typically limited by the dimensions of the offshore platform. Additionally, slip joints in a fluid-carrying system are undesirable when conveying a sour production fluid. The elastomeric seals used in such slip joints are subject to deterioration induced by compounds in the sour production fluid and will leak. Furthermore, the movement of the inner and outer pipes of the slip joint will abrade the elastomeric seal as the inner pipe reciprocates within the outer pipe. Such abrasion reduces sealing effectiveness as the elastomeric seals become worn. Finally, a slip joint is limited because it moves linearly and does not accommodate lateral movement of the offshore platform about the subsea well. This lateral movement of the offshore platform can be so severe as to damage the slip joint.

To avoid certain limitations of flexible hoses and slip joints, various combinations of in-line swivels and concentric swivels have been used to accommodate relative movement in a fluid-carrying system. However, swivels rely on elastomeric seals to seal the moving elements of the swivel. Such seals are subject to deterioration induced by a sour production fluid as previously described. Furthermore, swivel connections are limited to a particular range of movement and do not flex beyond such operating range. If a severe storm should displace an offshore platform to an extraordinary distance from its equilibrium position, the pipe connecting the swivels in a fluid-carrying system would not plastically deform but would rupture. Such rupture would release the pressurized production fluid into the ambiance.

A need, therefore, exists for a flexible apparatus in a fluid-carrying system to accommodate movement of a compliant offshore structure about a subsea well. Such flexible apparatus should be capable of conveying a sour production fluid which is produced at high pressures. The flexible apparatus should also accommodate, without leakage, cyclic as well as extreme displacements of a compliant offshore platform from its equilibrium position.

SUMMARY OF THE INVENTION

The present invention provides an apparatus for transporting a fluid between a compliant offshore structure and the sea floor while accommodating movement of the offshore structure. A riser means for transporting the fluid has a lower end and an upper end. The lower end of the riser means is connected to the sea floor. A The equations will depend upon the physical properties and configuration of a particular helical coil. For example, the stiffness of a helical coil can be varied by altering the yield strength of the material used. In addition, a helical coil manufactured from rectangular tubing will have a different moment of inertia than a helical coil manufactured from cylindrical tubing. Additionally, the size, shape, and number of turns in a helical coil will determine the dynamic response of the helical coil. For example, a conical helical coil will respond differently than a cylindrical helical coil to a particular displacement. Also, a reduction in the diameter of a helical coil will increase its stiffness while an increase in the diameter of a helical coil will reduce its stiffness. Moreover, an increase in the number of turns of a helical coil will reduce its stiffness while a reduction in the number of turns will increase its stiffness. Each helical coil can therefore be sized to accommodate the displacement anticipated in a given application.

A plurality of fluid-carrying systems, each having a helical coil, can be closely spaced together in an offshore structure. Preferably, when the structure is at its equilibrium postion, each helical coil is neither in compression nor in tension. The dynamic response of helical coils in a guyed tower is typical of such movement in compliant offshore structures. At equilibrium, the helical coils are preferably unstressed. As a loading force (F) displaces the guyed tower from its equilibrium position, the stress on each helical coil will vary according to the location of the helical coil in reference to the horizontal deck of the guyed tower. For example, certain helical coils, located along a vertical plane which intersects the center of the guyed tower but which is perpendicular to the displacing force, will remain unstressed. Other helical coils located at a distance from such vertical plane will be compressed or tensioned to compensate for movement of the guyed tower. The present invention automatically compensates for movement of a compliant offshore structure whether such movement compresses or elongates the helical coils.

If an offshore structure should be damaged due to a storm or accident, the helical flowline in the present invention will tend to plastically deform and thereby resist fracturing of the helical coil. Such fracturing could result in loss of fluids from the fluid-carrying system into the ambiance. If the displacement of the helical coil is compressive, the coils will "ground" against themselves and the helical coil will essentially accommodate the axial compressive force as a solid member. If the helical coil is elongated, the helical coil will tend to straighten. In either event, the helical flowline will accommodate an excessive deforming force through compressive or elongating deformation while resisting failure of the fluid-carrying system.

Figure 2:
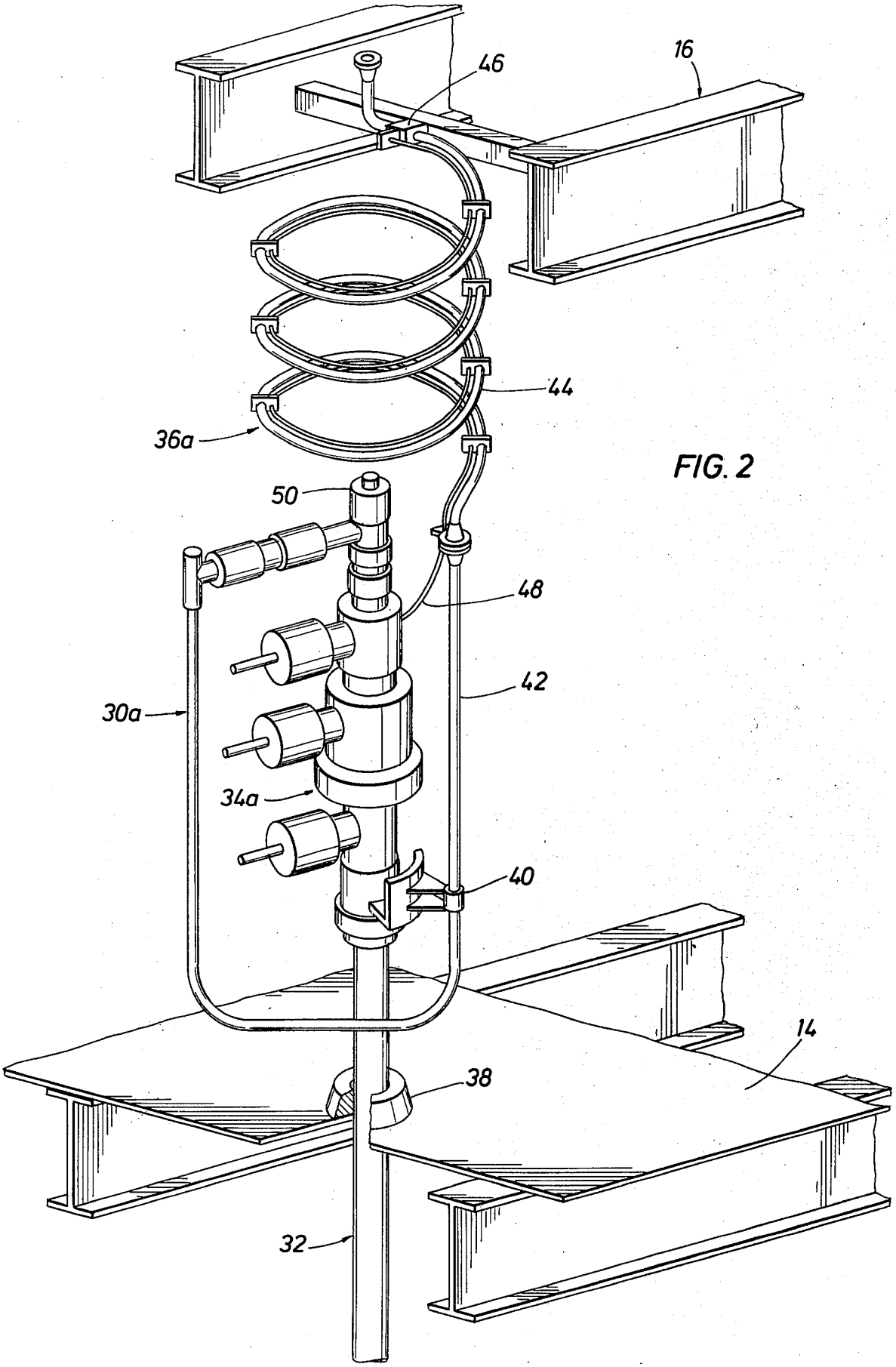
Figure 3B:
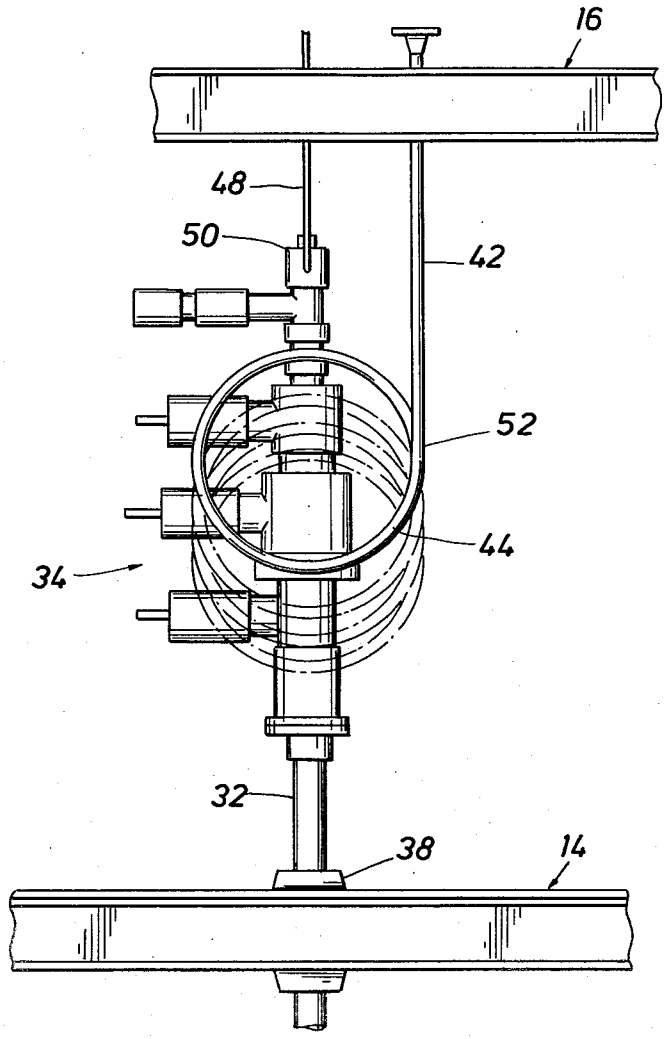
Figure 3A:
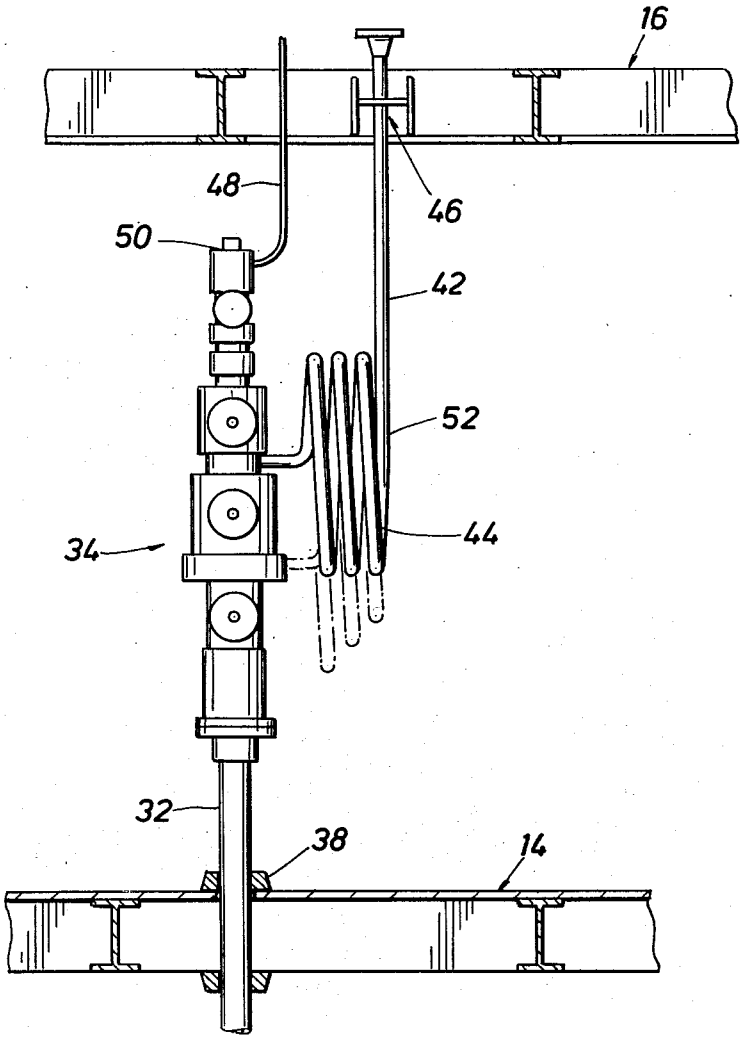

FIG. 3 illustrates and alternative embodiment of the present invention. Each element of the alternative embodiment is similar to a corresponding element in the preferred embodiment illustrated in FIGS. 1 and 2 except that bending coil 52 is substituted for helical coil 44. While helical coil 44 flexes due to torsional deflection, bending flowline 52 flexes due to bending deflection. Accordingly, the mathematical equations describing such bending deflection differ from those which describe torsional deflection. However, such bending equations are also well-known in the art and may be applied to varying configurations of bending coils.

The present invention is thus advantageous over flexible flowlines, slip joints, and swivel combinations in accommodating movement of a compliant offshore structure. Such movement is accommodated while fluids are conveyed between the offshore structure and the sea floor. The helical coils accommodate large displacements relative to spring size through elastic movement. In the event of excessive displacements due to a storm or accident, the helical flowline will resist failure by plastically deforming. The helical flowline in the present invention need not contain any sharp bends which are susceptible to pipe erosion due to hard particles such as sand in the production fluid. In addition, the helical coil amy comprise one piping member or a bundle of separate piping members. Because the present invention eliminates the need for elastomeric seals, the fluid-carrying system will resist corrosive fluids and will not leak.

Inasmuch as the present invention is subject to many variations, modifications, and changes in detail, it is intended that all subject matter discussed above or shown in the accompanying drawings be interpreted as illustrative and not in a limiting sense.

What is claimed is:

1. In a compliant offshore structure having a deck located above the water surface and being subject to movement induced by wind, waves, and ocean currents, an apparatus for transporting a fluid between the sea floor and the deck of said offshore structure, comprising:

a substantially rigid, vertical riser means for transporting said fluid, said riser means having a lower end connected to the sea floor and having an upper end which extends above the water surface;

a wellhead means affixed to said upper end of the riser means, there being relative movement between said wellhead means and the deck of said offshore structure as wind, waves and ocean currents move said offshore structure; and a helical flowline means having a first end connected to said wellhead means and having a second end connected to the deck of said offshore structure, said helical flowline means being capable of flexing to accommodate relative movement between said wellhead means and the deck of said offshore structure.

2. An apparatus as recited in claim 1, wherein said helical flowline means is generally shaped as a cylindrical helix.

3. An apparatus as recited in claim 1, wherein said helical flowline means is generally shaped as a conical helix.

4. An apparatus as recited in claim 1, wherein the centerline of said helical flowline means is substantially parallel to the axis of said riser means so that movement between said wellhead means and the deck of said offshore structure is accommodated by torsional deflection of said helical flowline means.

5. An apparatus as recited in claim 1, wherein the centerline of said helical flowline means is substantially perpendicular to the axis of said riser means so that movement between said wellhead means and the deck of said offshore structure is accommodated by bending deflection of said helical flowline means.

6. An apparatus as recited in claim 4, wherein the centerline of said helical flowline means is substantially coaxial with the axis of said riser means.

7. In a compliant offshore structure having a deck located above the water surface and being subject to movement induced by wind, waves, and ocean currents, an apparatus for transporting a fluid between the sea floor and the deck of said offshore structure, comprising:

a substantially rigid, vertical riser means for transporting said fluid, said riser means having a lower end connected to the sea floor and having an upper end which extends above the water surface;

a wellhead means affixed to said upper end of the riser means, there being relative movement between said wellhead means and the deck of said offshore structure as wind, waves and ocean currents move said offshore structure; and a helical flowline means having a first end connected to said wellhead means and having a second end connected to the deck of said offshore structure such that the centerline of said helical flowline means is substantially coaxial with the axis of said riser means, said helical flowline means being capable of flexing to accommodate relative movement between said wellhead means and the deck of said offshore structure.

8. An apparatus as recited in claim 7, wherein said helical flowline means is generally shaped as a cylindrical helix.

9. An apparatus as recited in claims 7 or 8, wherein the inside diameter of said helical flowline means is unobstructed in order to permit the passage of workover or wireline equipment therethrough.

10. In a compliant offshore structure having a deck located above the water surface and being subject to movement induced by wind, waves, and ocean currents, an apparatus for transporting a fluid between the sea floor and the deck of said offshore structure, comprising:

a substantially rigid, vertical riser means for transporting said fluid, said riser means having a lower end connected to the sea floor and having an upper end which extends above the water surface;

a wellhead means affixed to said upper end of the riser means, there being relative movement between said wellhead means and the deck of said offshore structure as wind, waves and ocean currents move said offshore structure; and a helical flowline means having a first end connected to said wellhead means and having a second end connected to said offshore structure such that the centerline of said helical flowline means is substantially perpendicular to the axis of said riser means so that movement between said wellhead means and the deck of said offshore structure is substantially accommodated by bending deflection of said helical flowline means.

11. An apparatus as recited in claim 10, wherein said helical flowline means is generally shaped as a cylindrical helix.

12. An apparatus as recited in claim 10, wherein said helical flowline means is generally shaped as a conical helix.

13. In a compliant offshore structure having a deck located above the water surface and being subject to movement induced by wind, waves, and ocean currents, a system for transporting fluids between the sea floor and the deck of said offshore structure, comprising:

at least two substantially rigid, vertical riser means for transporting the fluids, each riser means having a lower end connected to the sea floor and having an upper end which extends above the water surface;

a wellhead means affixed to the upper end of each riser means, there being relative movement between each wellhead means and the deck of said offshore structure as wind, waves and ocean currents move said offshore structure; and a helical flowline means connected between each wellhead means and the deck of said offshore structure, wherein each helical flowline means is capable of flexing to accommodate relative movement between said wellhead means and the deck of said offshore structure.

* * * * *